US011976460B1

(12) United States Patent
Schneider

(10) Patent No.: US 11,976,460 B1
(45) Date of Patent: May 7, 2024

(54) SECURITY ANCHOR AND METHOD

(71) Applicant: James E. Schneider, Zephyrhills, FL (US)

(72) Inventor: James E. Schneider, Zephyrhills, FL (US)

( * ) Notice: Subject to any disclaimer, the term of this patent is extended or adjusted under 35 U.S.C. 154(b) by 615 days.

(21) Appl. No.: 17/108,335

(22) Filed: Dec. 1, 2020

Related U.S. Application Data

(60) Provisional application No. 62/943,910, filed on Dec. 5, 2019.

(51) Int. Cl.
*E04B 1/41* (2006.01)

(52) U.S. Cl.
CPC ..... *E04B 1/41* (2013.01)

(58) Field of Classification Search
CPC . E04B 1/41; E04B 1/4107; E04B 1/40; E04B 1/405
USPC ..... 248/499, 500, 503
See application file for complete search history.

(56) References Cited

U.S. PATENT DOCUMENTS 1,497,093 A * 6/1924 Dolan ..... B60R 25/00 70/225
3,124,385 A * 3/1964 Neptune ..... F16G 11/02 52/704
3,431,012 A * 3/1969 Eriksson ..... B28B 23/005 52/125.4
3,658,037 A * 4/1972 Hunter ..... A01K 1/04 473/149
3,955,847 A 5/1976 Schiowitz
4,017,115 A * 4/1977 Holt ..... E04G 15/061 411/21
4,018,470 A * 4/1977 Tye ..... B66C 1/666 52/707
4,060,244 A * 11/1977 Graham ..... A63C 19/00 473/499
4,068,879 A * 1/1978 Torbet ..... B66C 1/666 52/707
4,179,151 A * 12/1979 Tye ..... E04G 21/142 52/707
4,262,951 A * 4/1981 Hoyer ..... B66C 1/666 294/82.23
4,290,638 A * 9/1981 Manning ..... B66C 1/666 52/707
4,297,962 A 11/1981 Johnson, Jr.
4,642,964 A * 2/1987 Kellison ..... F16B 13/141 52/705
4,872,298 A 10/1989 Klemic, Jr.
4,907,921 A 3/1990 Akright
(Continued)

*Primary Examiner* — Nkeisha Smith
(74) *Attorney, Agent, or Firm* — Frijouf, Rush & Pyle, P.A.

(57) ABSTRACT

A security anchor and method are disclosed for engaging with a rigid material. The security anchor comprises a base having a lower surface and an upper surface. A base recess extends into the base from the upper surface of the base. An eyelet is coupled to the base and is positioned within the base recess. An elongated shank extends between a proximal end and a distal end. The proximal end of the elongated shank is coupled to the lower surface of the base. The elongated shank has a head coupled to the distal end of the elongated shank. The elongated shank and the head engage with the rigid material for preventing the displacement of the base relative to the rigid material. The eyelet engages with an object for securing the object relative to the rigid material.

17 Claims, 9 Drawing Sheets

(56) References Cited

U.S. PATENT DOCUMENTS

| | | | | |
|---|---|---|---|---|
| 5,332,191 | A * | 7/1994 | Nolan | B28B 7/02 249/4 |
| 5,456,443 | A * | 10/1995 | Taaffe | B60R 25/00 70/DIG. 57 |
| 6,102,607 | A * | 8/2000 | Kintscher | B28B 23/005 52/587.1 |
| 6,105,332 | A | 8/2000 | Boyadjian | |
| 6,138,975 | A * | 10/2000 | McDaid | B61D 45/001 248/499 |
| 6,435,137 | B1 * | 8/2002 | Hourihan | A01K 1/04 119/788 |
| 6,688,049 | B2 * | 2/2004 | Sanftleben | E04G 15/04 52/125.4 |
| 6,688,808 | B2 * | 2/2004 | Lee | E01C 5/005 404/34 |
| 7,134,819 | B2 | 11/2006 | Bullock et al. | |
| 8,875,471 | B2 * | 11/2014 | Siqueiros | E04B 1/3511 52/707 |
| 10,472,835 | B2 * | 11/2019 | Mayer, III | E04G 21/3276 |
| 10,752,472 | B2 * | 8/2020 | Connell | E04B 1/3511 |
| 10,767,323 | B2 * | 9/2020 | Connell | E01C 11/005 |
| 11,434,654 | B2 * | 9/2022 | Ramadan | E04F 11/1812 |
| 11,661,741 | B2 * | 5/2023 | Hun | B28B 19/003 249/188 |
| 2004/0113039 | A1 | 6/2004 | Becker | |
| 2007/0028552 | A1 * | 2/2007 | DeLoach | E04C 5/16 52/414 |
| 2007/0284503 | A1 | 12/2007 | Kirkpatrick | |
| 2009/0032671 | A1 * | 2/2009 | Perry | B61D 45/001 248/499 |
| 2018/0058062 | A1 * | 3/2018 | Mayer | E04B 1/4142 |
| 2019/0292771 | A1 * | 9/2019 | Zhao | F16B 13/141 |
| 2020/0284028 | A1 * | 9/2020 | Fujita | F16B 5/08 |

* cited by examiner

SECURITY ANCHOR AND METHOD

CROSS-REFERENCE TO RELATED APPLICATIONS

This application claims benefit of U.S. Patent Provisional application No. 62/943,910 filed Dec. 5, 2019. All subject matter set forth in provisional application No. 62/943,910 is hereby incorporated by reference into the present application as if fully set forth herein.

BACKGROUND OF THE INVENTION

Field of the Invention

This invention relates to anchors and more particularly to a security anchor and method.

Background of the Invention

Theft of objects from commercial and residential property leads to loss of money and time that may greatly affect the overall economy on a local and regional level. Any device that may reduce theft of these objects would be a great benefit to an individual or company and could greatly improve your overall economy on the local and regional level.

There have been many in the prior art who have attempted to solve these problems with varying degrees of success. None, however completely satisfies the requirements for a complete solution to the aforestated problem. The following U. S. Patents are attempts of the prior art to solve this problem U.S. Pat. No. 3,955,847 to Schiowitz discloses a person seated in a wheelchair or other wheeled patient carrier is enabled to board a vehicle while remaining in the carrier. A hold down device secured to the vehicle floor restrains the carrier against movement regardless of acceleration or emergency braking of the vehicle, and a belt arrangement can be provided to secure the passenger in the wheeled carrier.

U.S. Pat. No. 4,297,962 to Johnson, Jr. discloses a hinged cleat assembly for the deck of boats and the like is comprised by a T-shaped cleat formed by a contoured rod with two opposed, U-shaped ears interconnected at a midpoint of the cleat and two stem sections connected with the ears. A base plate is connected to the depending ends of the stem sections by means of a hinge which allows the cleat to be folded from an operative, upright position to a folded position relative to the deck.

U.S. Pat. No. 4,872,298 to Klemic, Jr. discloses an assemblage for setting an anchor in a mass of concrete is shown. It comprises an anchor and a setting bolt, which have mating threads. Once the anchor is set, other bolts can replace the setting bolt and then be used outside the wall for various purposes. For instances, with a bolt that extends outside the wall, the system can be used to erect a scaffold.

U.S. Pat. No. 4,907,921 to Akright discloses a tie-down assembly is disclosed which includes a plastic guard rail that defines a central floor and spaced, parallel interior walls which cooperate to define a recess, a pair of beveled exterior surfaces disposed outside of the respective interior walls, and an array of slits in the floor. A clamp formed of a folded piece of sheet metal defines a sleeve section disposed in the recess and a shank section which passes through one of the slits in the floor. A tie-down ring is pivotably mounted in the sleeve section and is movable between a stowed position, in which no part of the clamp or tie-down member extends out of the recess, and a use position. Aligned openings are defined by the floor and the shank section of the clamp, and a single fastener can be positioned to pass through the aligned openings in order to secure the entire tie-down assembly in place.

U.S. Pat. No. 5,456,443 to Taaffe discloses an anchoring device particularly useful for the anchoring of vehicles, bicycles, motorbikes, televisions, VCR, etc. The device 1 comprises an anchor means 13, able to be securely fastened to a substrate surface, having an upwardly protruding portion 16 provided with an orifice 17 therethrough. Over the anchor means 13, is supplied a covering means 14 to substantially cover the anchor means 13 except for the protruding portion 16. In use, with the covering means 14 covering the anchor means 13, a padlock, chain, wire or the like is supplied through the orifice 17, such that the covering means 14 is unable to be removed from the anchor means 16. Consequently, access to the anchor means, for removal of the device 1 from the substrate, is prevented.

U.S. Pat. No. 6,105,332 to Boyadjian discloses a sill plate that is mounted on a cement footing of a building structure with anchor bolts being fixedly embedded within the cement footing in spaced apart locations with these anchor bolts protruding from the uppermost surface of the cement footing. Each anchor bolt is to be located within an oversized hole formed in the sill plate. An anchoring plate is to be fixedly secured to the sill plate with there being a separate anchoring plate for each anchor bolt. There is a closely conforming hole formed within the anchoring plate through which this anchor bolt is to extend. A fastening arrangement is utilized to fixedly secure each anchoring plate on the sill plate.

U.S. Pat. No. 6,138,975 to McDaid discloses an anchored tie-down ring that mounts in or on a concrete surface to which a movable object can be secured. One embodiment includes a generally U-shaped ring with a hollow cylindrical crossbar that sits within a cavity in a block mounted flush with a concrete surface. One end of each of a pair of legs fits into the crossbar and acts as a bearing on which the ring pivots. The legs extend through the block into the concrete as an anchor. Another embodiment includes a generally U-shaped ring that is pivotally mounted in a block. Anchor bolts extend through holes in the block into the concrete surface. A rounded cover is secured to the block, denying access to the anchor bolts, and includes a cavity so that the ring lays horizontally within the cover when not in use.

U.S. Pat. No. 7,134,819 to Bullock et al. discloses a tie-down assembly includes a housing configured to receive a pair of bails. A cross-bar and post are used to rotatably connect the bails to the housing. The pair of bails can be identical to allow a strap to be cinched to the housing. Alternatively, the bails can be shaped differently, for example, to center a strap within the bail or to facilitate the use of multiple straps.

United States Patent Application 2004/0113039 to Becker discloses a wall/ground anchor for the securing of movable articles, in particular of bicycles, to the ground or to a wall, comprising an anchor plate attachable to the ground or to the wall and at which two shackles are provided, and a securing hoop (30) having two free ends which are each upwardly curved toward one another through an associated shackle such that the securing hoop is pivotally supported at the shackles.

United States Patent Application 2007/0284503 to Kirkpatrick discloses an anchor for securing equipment to a substrate comprising a base that includes two barrels that are configured to pivotally receive a pivot pin having an anchor loop, the base further comprising at least one installation aperture located on the periphery of the base and at least one anchor bolt with a drive inset, at least one for each installation aperture.

Although the aforementioned prior art have contributed to the development of the art of security anchor devices none of these prior art patents have solved the needs of this art.

Therefore, it is an object of the present invention to provide an improved security anchor which is a significant advancement over the prior art.

Another object of this invention is to provide an improved security anchor that does not impede or obstruct an object traveling over the improved security anchor.

Another object of this invention is to provide an improved security anchor that will not pool a liquid within the improved security anchor.

Another object of this invention is to provide an improved security anchor that may be utilized with new construction.

Another object of this invention is to provide an improved security anchor that may be utilized with existing construction.

Another object of this invention is to provide an improved security anchor that may be utilized within soil.

Another object of this invention is to provide an improved security anchor that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved security anchor for securing an object relative to a rigid material. The security anchor comprises a base having a lower surface and an upper surface. A base recess extends into the base from the upper surface of the base. An eyelet is coupled to the base and is positioned within the base recess. A plurality of elongated shanks extends between a proximal end and a distal end. The proximal end of the plurality of elongated shanks are coupled to the lower surface of the base. The plurality of elongated shanks each have a head coupled to the distal end of the plurality of elongated shanks. The plurality of elongated shanks and the heads engage with the rigid material for preventing the displacement of the base relative to the rigid material. The eyelet engages with the object for securing the object relative to the rigid material.

In a more specific embodiment of the invention, a sub-base has a lower surface and an upper surface. The upper surface of the sub-base is coupled to the lower surface of the base. The eyelet is coupled to the sub-base.

In another embodiment of the invention, an anchor body engages with the plurality of elongated shanks for defining an independent locking anchor. The independent locking anchor engages with the rigid material for preventing the displacement of the independent locking anchor relative to the rigid material.

The invention is also incorporated into the method of securing an object relative to a curable material on a surface. The method comprises the steps of spreading the curable material on the surface. A base having a plurality of anchors is positioned into the curable material for preventing the displacement of the base relative to the curable material once the curable material has cured. An eyelet is pivoted relative to the base for coupling the object to the base.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar pans throughout the several Figures of the drawings.

DETAILED DISCUSSION

Figure 15:
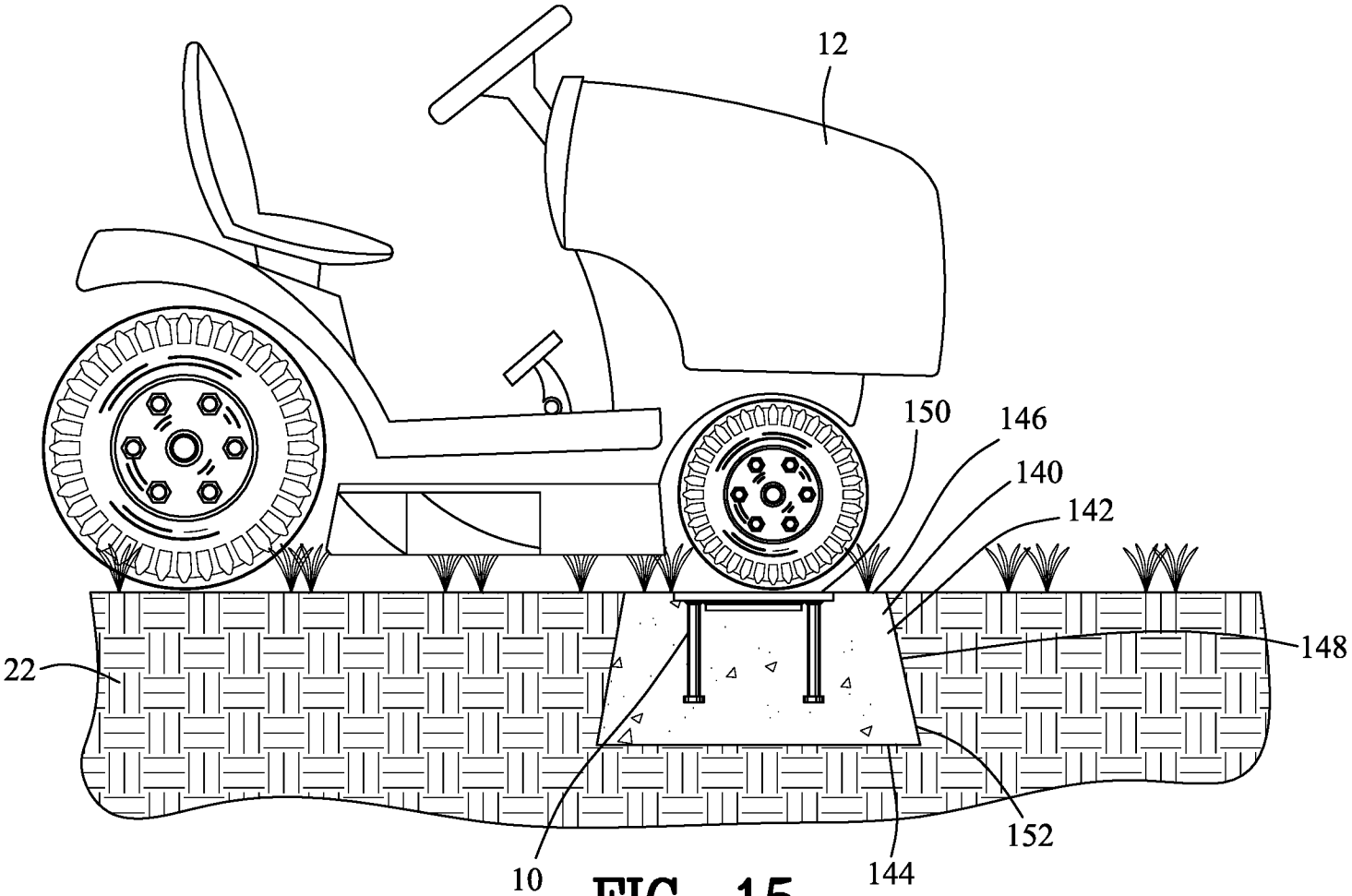
FIG. 15 is a view similar to FIG. 2 illustrating the security anchor is positioned within a anchor body.

FIGS. 1-15 illustrate a security anchor 10 engaging with a rigid material 20 for securing an object 12 relative to the rigid material 20. The object 12 may include but not limited to objects such as a vehicle, recreational vehicle, trailer, riding lawnmower, motorcycle, bicycle, scooter, generator, tent, water vessel, tarp or other mobile objects. The object 12 may also include but not limited to objects such as stationary mobile home, shed, tower, or other non-mobile objects. The rigid material 20 may include but not limited to soil 22 as shown in FIG. 15, a curable material such as concrete or epoxy 24 as shown in FIGS. 5-14, concrete slab 26 as shown in FIGS. 5-14 or other materials.

The security anchor 10 comprises a base 50 having a lower surface 52, an upper surface 54 and side surfaces 56. A base recess 60 extends into the base 50 from the upper surface 54 of the base 50. The base recess 60 includes recess sidewalls 62. The base 50 may be constructed from a metallic, polymeric, carbon fiber, or other rigid materials and their combinations.

An eyelet 70 is coupled to the base 50 and is positioned within the base recess 60. The eyelet 70 may include a D-ring eyelet 72. Alternatively, the eyelet 70 may include elliptical, rectangular, V-shaped or other geometric shaped rings. Preferably, the base recess 60 has a slightly larger and equivalent shape as the eyelet 70. For example, wherein the eyelet 70 includes a D-ring eyelet 72, the base recess 60 has an arcuate portion and a general square shaped recess for receiving the D-ring eyelet 72. Alternatively, wherein the eyelet 70 includes a V-shaped eyelet, the base recess 60 has a V-shaped portion and a general square shaped recess for receiving the V-shaped eyelet. The eyelet 70 may be constructed from a metallic, polymeric, carbon fiber, or other rigid materials and their combinations.

As best shown in FIGS. 2, 4, 8, 14 and 15, the upper surface 54 of the base 50 and the eyelet 70 may define a flush upper surface 74 relative to the upper surface 54 of the base 50 and the eyelet 70. The flush upper surface 74 may avoid impeding or obstructing an object 12 traveling over the security anchor 10. Similarity, the upper surface 54 of the base 50 and the rigid material 20 may define flush upper surface 74 relative to the upper surface 54 of the base 50 and the rigid material 20. The flush upper surface 74 may avoid impeding or obstructing an object 12 traveling between the rigid material 20 to the upper surface 54 of the base 50.

A pivot link 100 may be coupled to the base 50. The eyelet 70 pivotably engages with the pivot link 100 for pivoting the eyelet 70 relative to the base 50. Preferably, the pivot link 100 and the upper surface 54 of the base define a flush upper surface 102. The flush upper surface 102 may avoid impeding or obstructing an object 12 traveling over the security anchor 10. The pivot link 100 may be coupled the base 50 by a weld coupling 104. The pivot link 100 may be constructed from a metallic, polymeric, carbon fiber, or other rigid materials and their combinations.

An elongated shank 78 or a plurality of elongated shanks 80 extends between a proximal end 82 and a distal end 84. The proximal end 82 of the plurality of elongated shanks 80 are coupled to the lower surface 52 of the base 50. The plurality of elongated shanks 80 may each have a head 86 coupled to the distal end 84 of the plurality of elongated shanks 80. The plurality of elongated shanks 80 and the heads 86 engage with the rigid material 20 for preventing the displacement of the base 50 relative to the rigid material 20. The plurality of elongated shanks 80 may be constructed from a metallic, polymeric, carbon fiber, or other rigid materials and their combinations.

Figure 16:
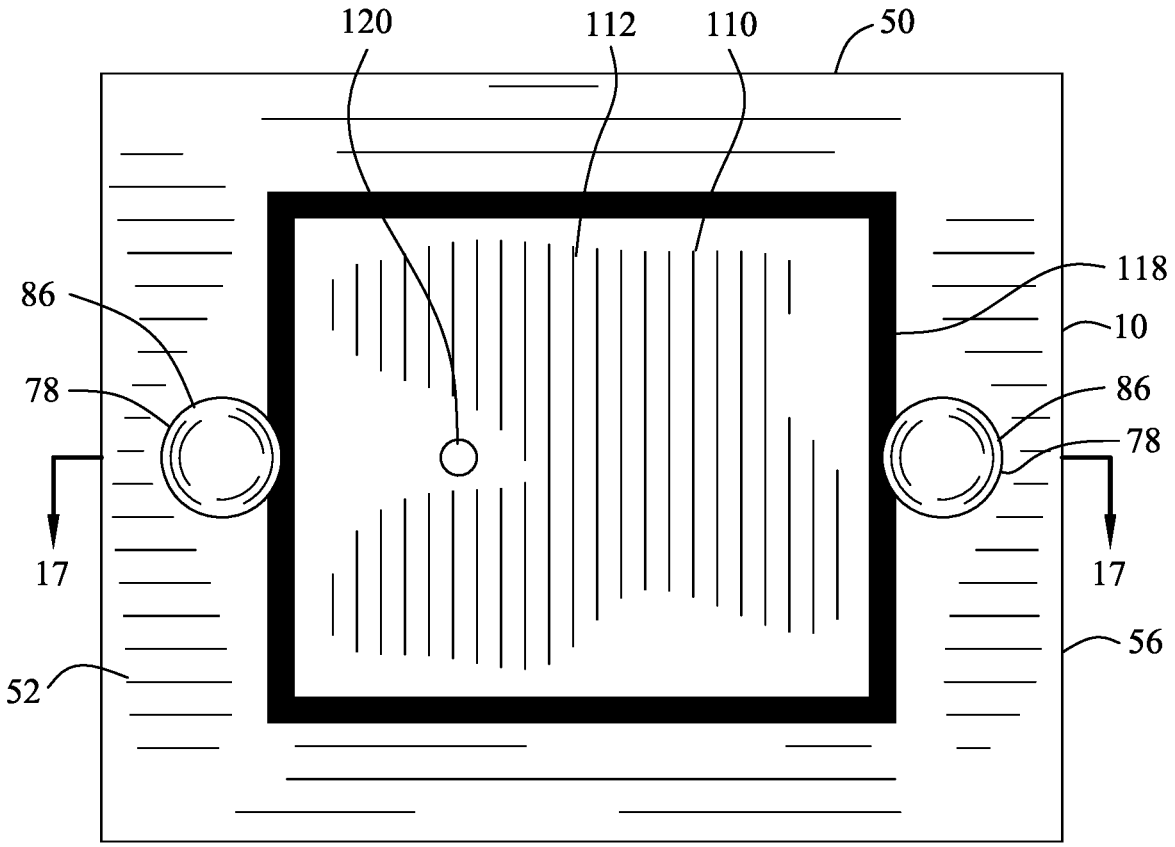
FIG. 16 is a view similar to FIG. 3 illustrating a second embodiment of the security anchor incorporating the present invention.
Figure 17:
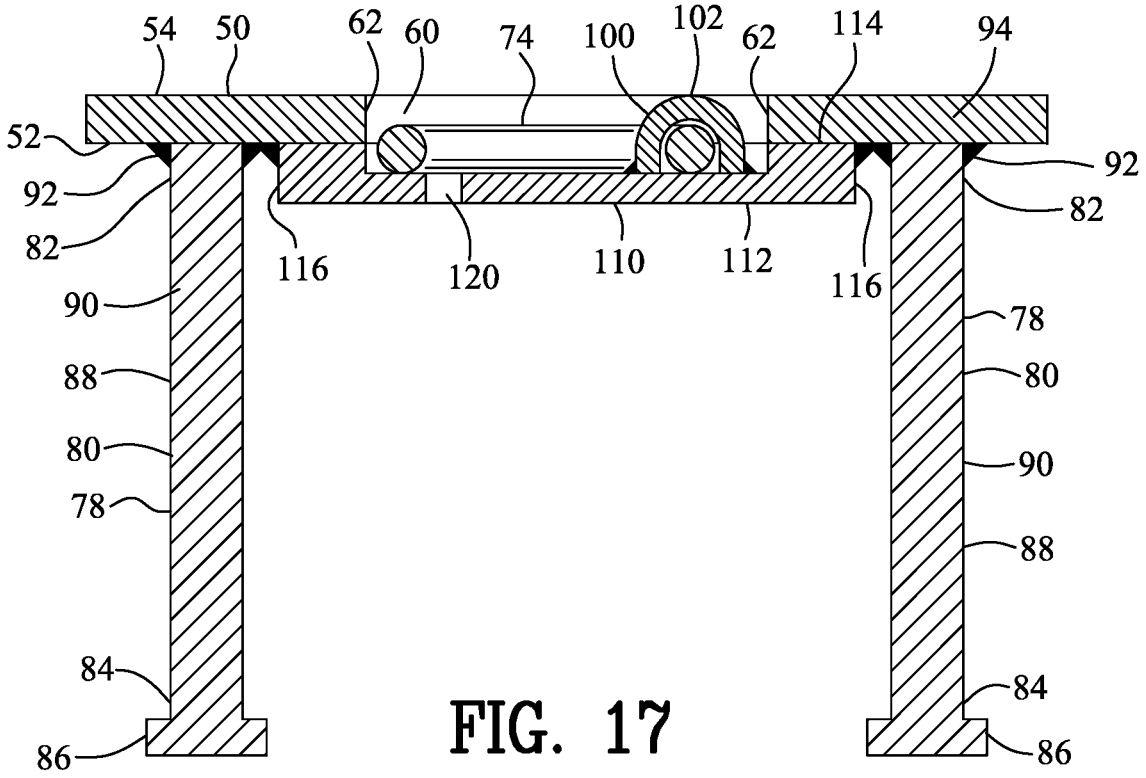
FIG. 17 is a sectional view along line 17-17 in FIG. 16.

As shown in FIGS. 1-4, the security anchor 10 may include four (4) elongated shanks 80. As shown in FIGS. 16-17, the security anchor 10 may include two (2) elongated shanks 80. It should be understood that the security anchor 10 may include one elongated shanks 78 or a plurality of elongated shanks 80 depending upon size of the security anchor 10 and/or the holding force needed to retain the security anchor 10 within the rigid material 20. For example, if the overall area of the security anchor 10 is quite small, only a single elongated shank 78 is needed. If the overall area of the security anchor 10 is large, a plurality of elongated shanks 80 may be required. In addition, if the security anchor 10 will only be exposed to a low retaining force, only a single elongated shank 78 may be needed. However, if the security anchor 10 will be exposed to a large retaining force a plurality of elongated shanks 80 may be required.

Preferably, the base 50, the plurality of elongated shanks 80 and the heads 86 define an integral one piece unit 88. More specifically, the plurality of elongated shanks 80 and the heads 86 may define a bolt 90. The bolt 90 is coupled to the lower surface 52 of the base 50 for defining an integral one piece unit 88. The bolt 90 may be coupled to the base 50 by a weld coupling 92, adhesive or other coupling means. The integral one piece unit 88 may be coated or treated to prevent corrosion. For example, the integral one piece unit 88 may be treated by hot-dip galvanization, coated by rust inhibitor, paint or other treatments. The integral one piece unit 88 may have a reflective coating or high visible color for locating the security anchor 10 from a distance.

Since the plurality of elongated shanks 80 are coupled to the lower surface 52 of the base 50, the security anchor 10 is not vulnerable from the upper surface 52 of the base 50 in an attempt to separate the plurality of elongated shanks 80 from the base 50.

Alternatively, the plurality of elongated shanks 80 may be threadably engaged with the base 50. More specifically, the base 50 may include one or more threaded sockets 94 for receiving threads 96 on the plurality of elongated shanks 80. Preferably, the threads 96 of the plurality of elongated shanks 80 would not protrude past the upper surface 54 of the base 50. By including threaded sockets 94 within the base 50 alternative elongated shanks 80 may be utilized with the base 50 for different applications. More specifically, the elongated shanks 80 may include a cork screw type of structure, a L-shaped type structure or other anchoring shapes.

Figure 1:
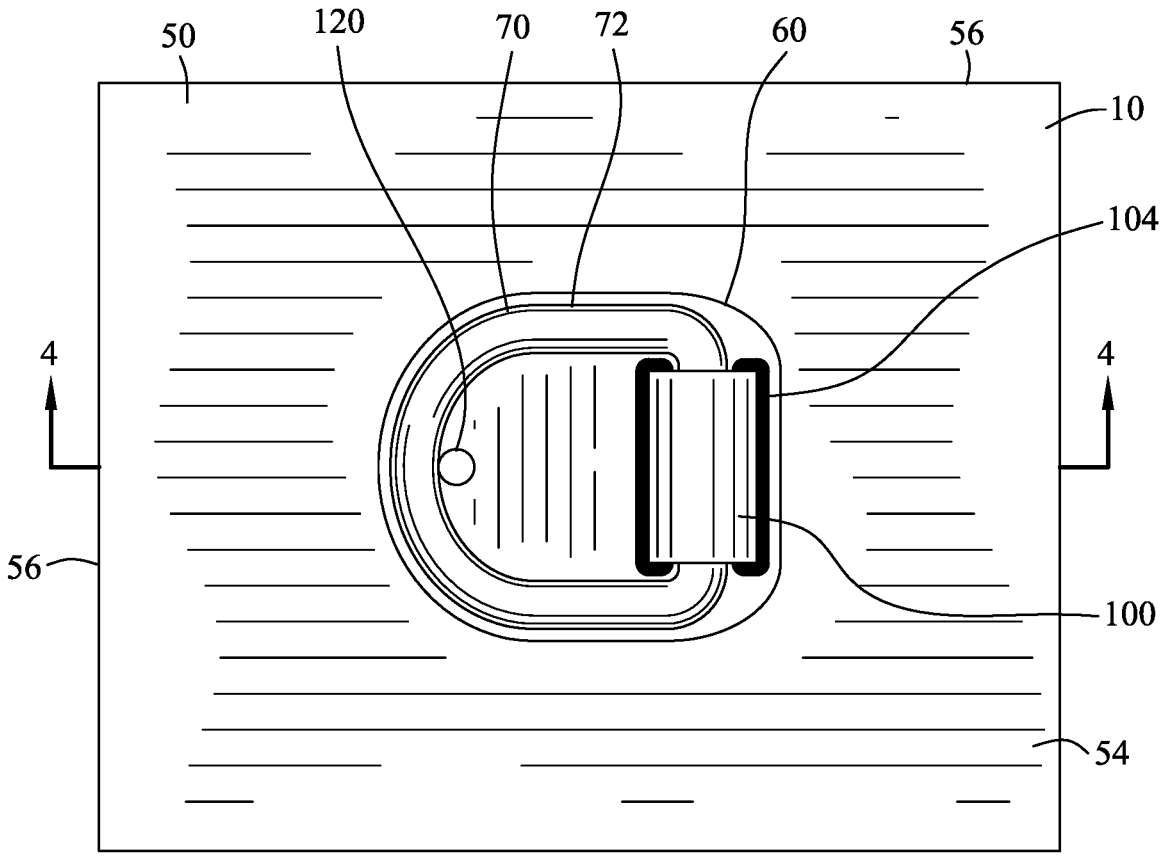
FIG. 1 is a top view of a security anchor incorporating the present invention.
Figure 2:
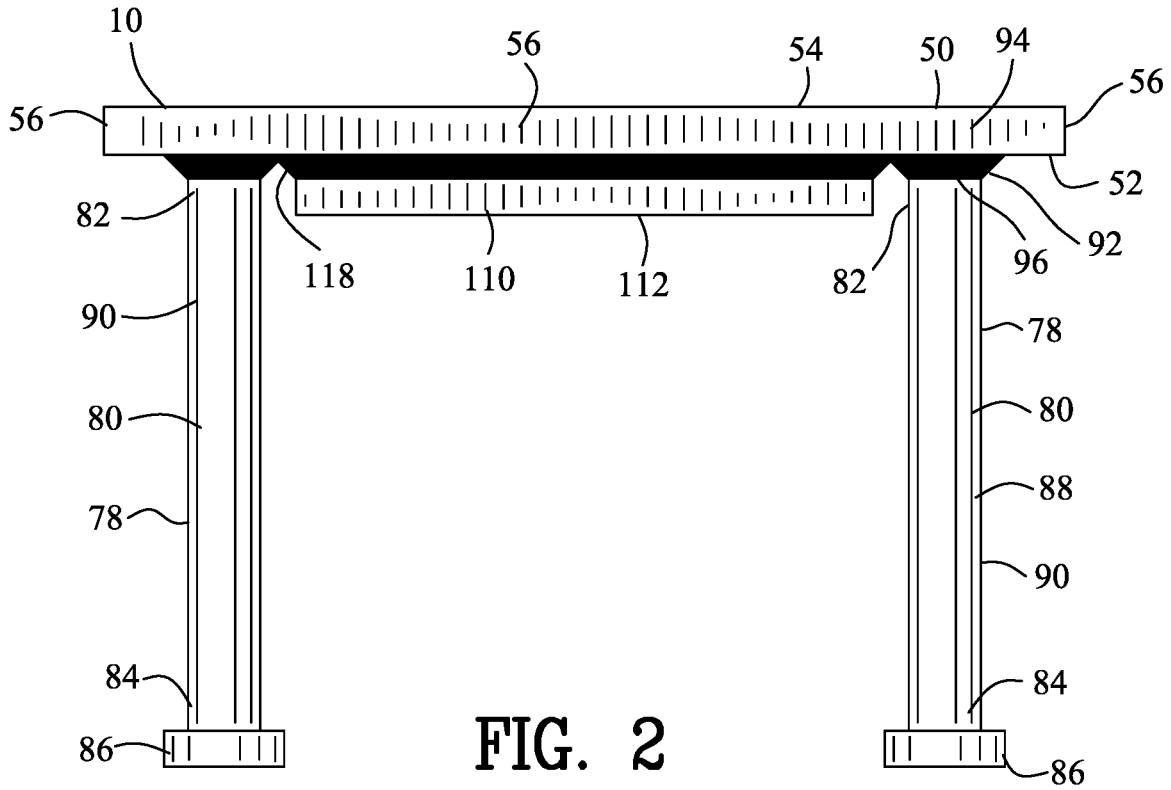
FIG. 2 is a front view of FIG. 1.
Figure 3:
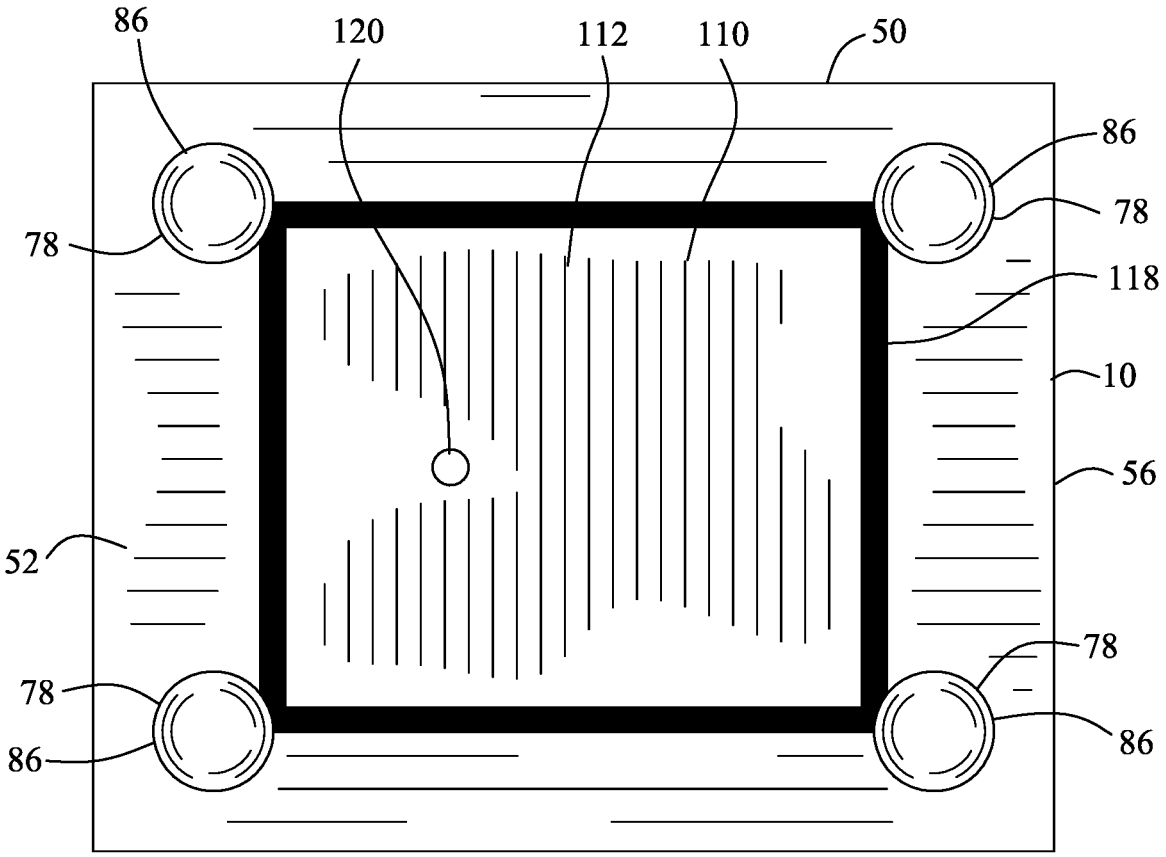
FIG. 3 is a bottom view of FIG. 1.
Figure 4:
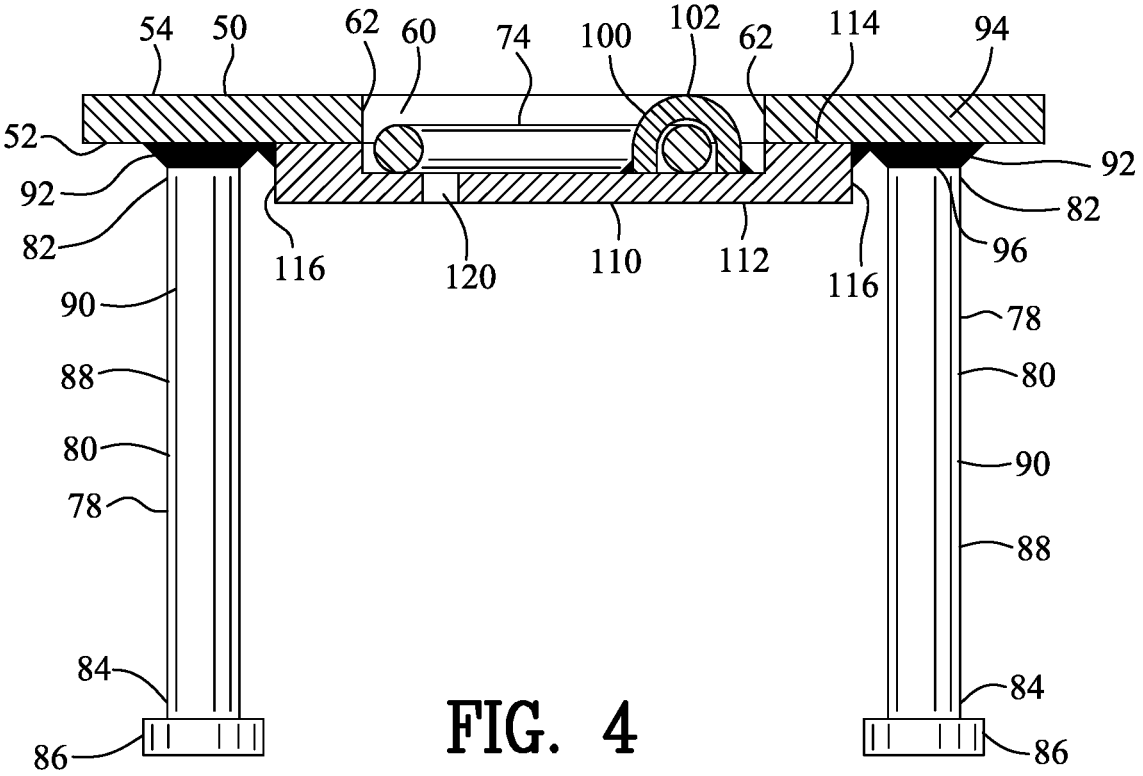
FIG. 4 is a sectional view along line 4-4 in FIG. 1.
Figure 5:
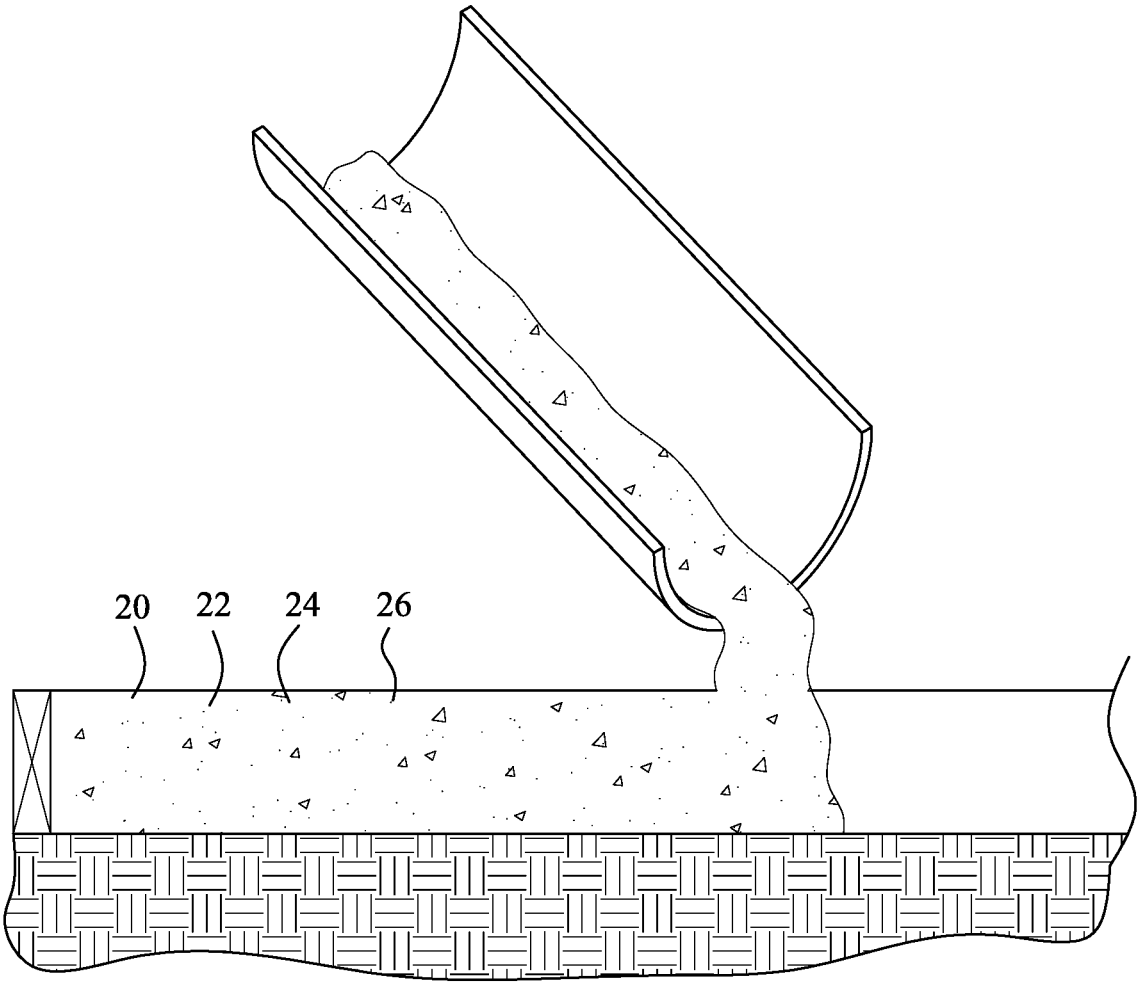
FIG. 5 is an elevational view of a first step for securing an object with the security anchor shown in FIG. 1 illustrating spreading a curable material on a surface.
Figure 6:
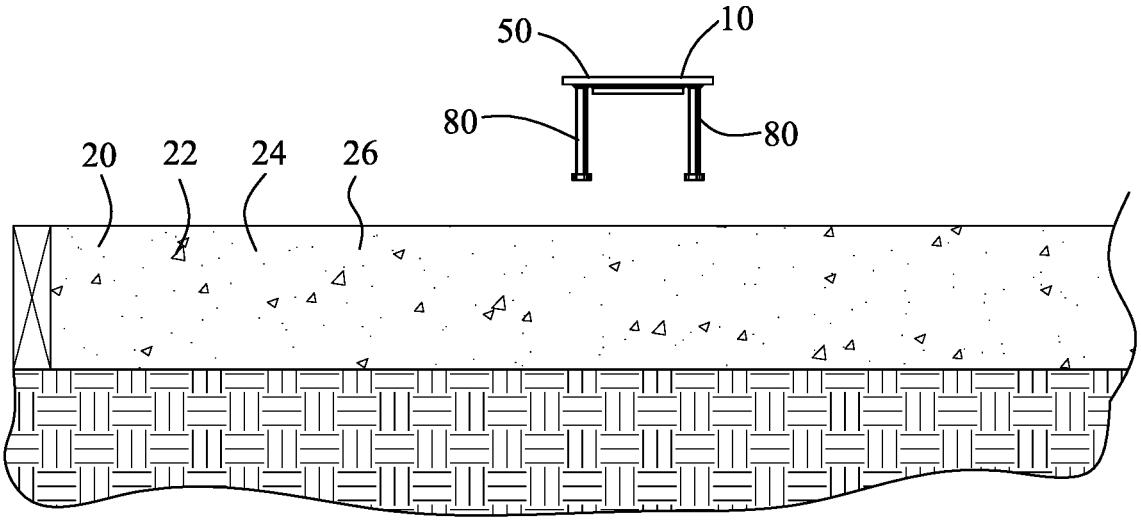
FIG. 6 is a view similar to FIG. 5 illustrating the security anchor positioned above the curable material.
Figure 7:
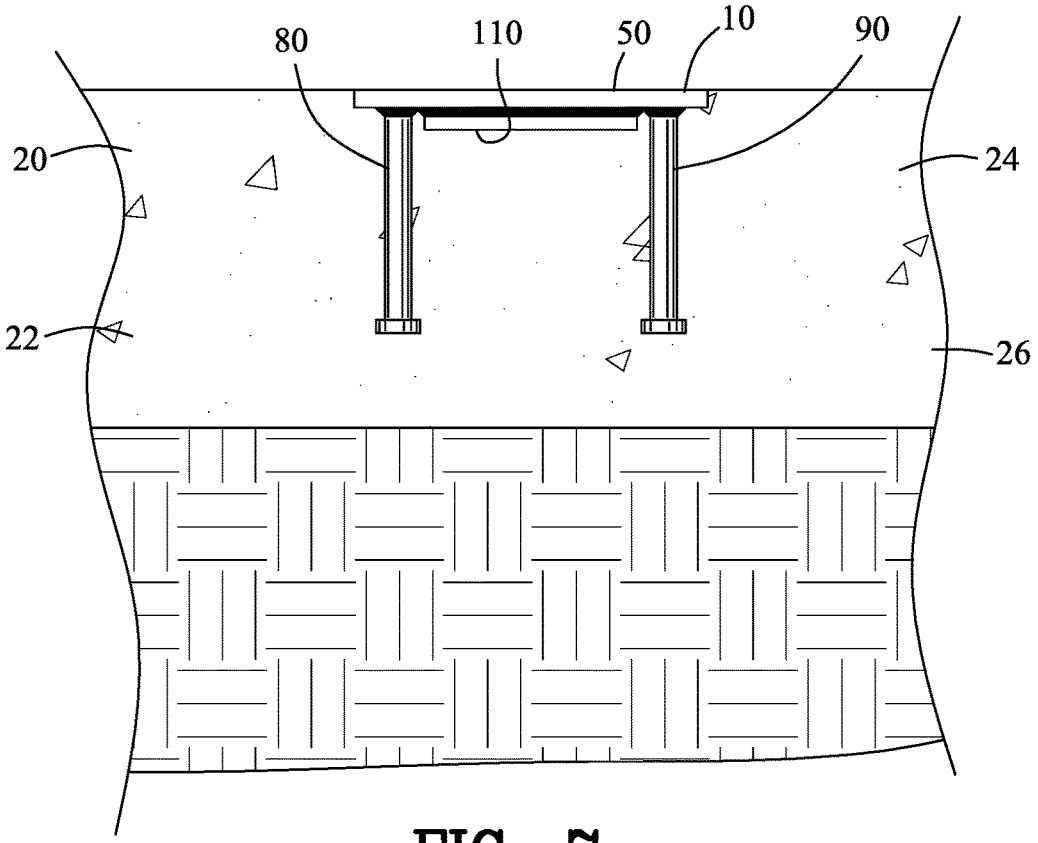
FIG. 7 is a view similar to FIG. 6 illustrating the security anchor positioned within the curable material.
Figure 8:
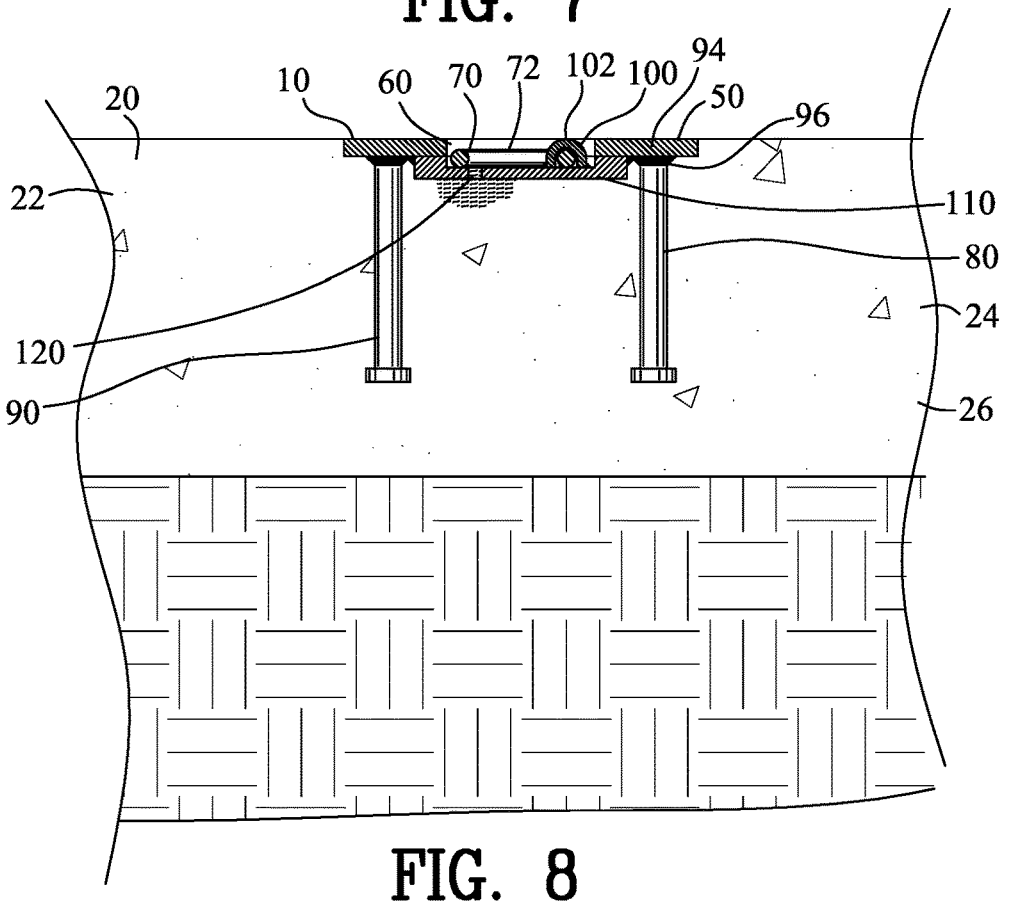
FIG. 8 is a view similar to FIG. 7 with the security anchor in sectional view as shown in FIG. 4.
Figure 9:
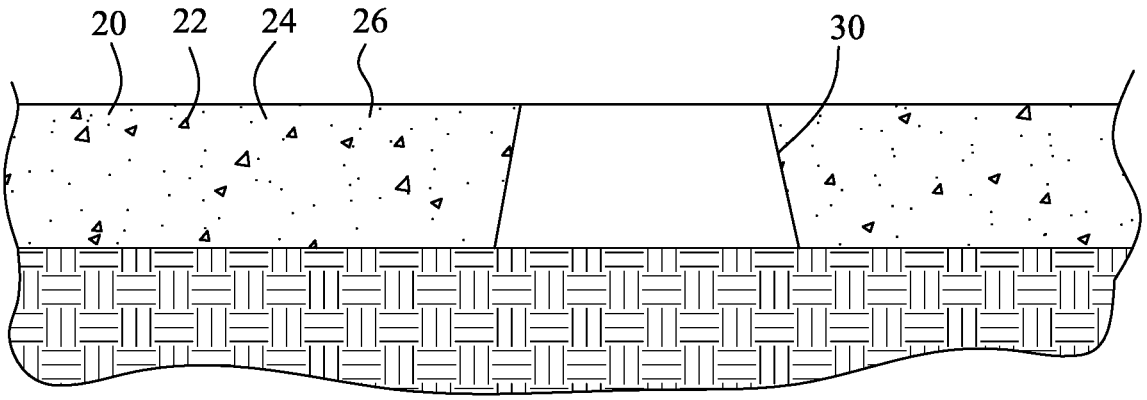
FIG. 9 is an elevational view of an alterative first step for securing the object with the security anchor shown in FIG. 1 illustrating cutting a recess into a rigid material.
Figure 10:
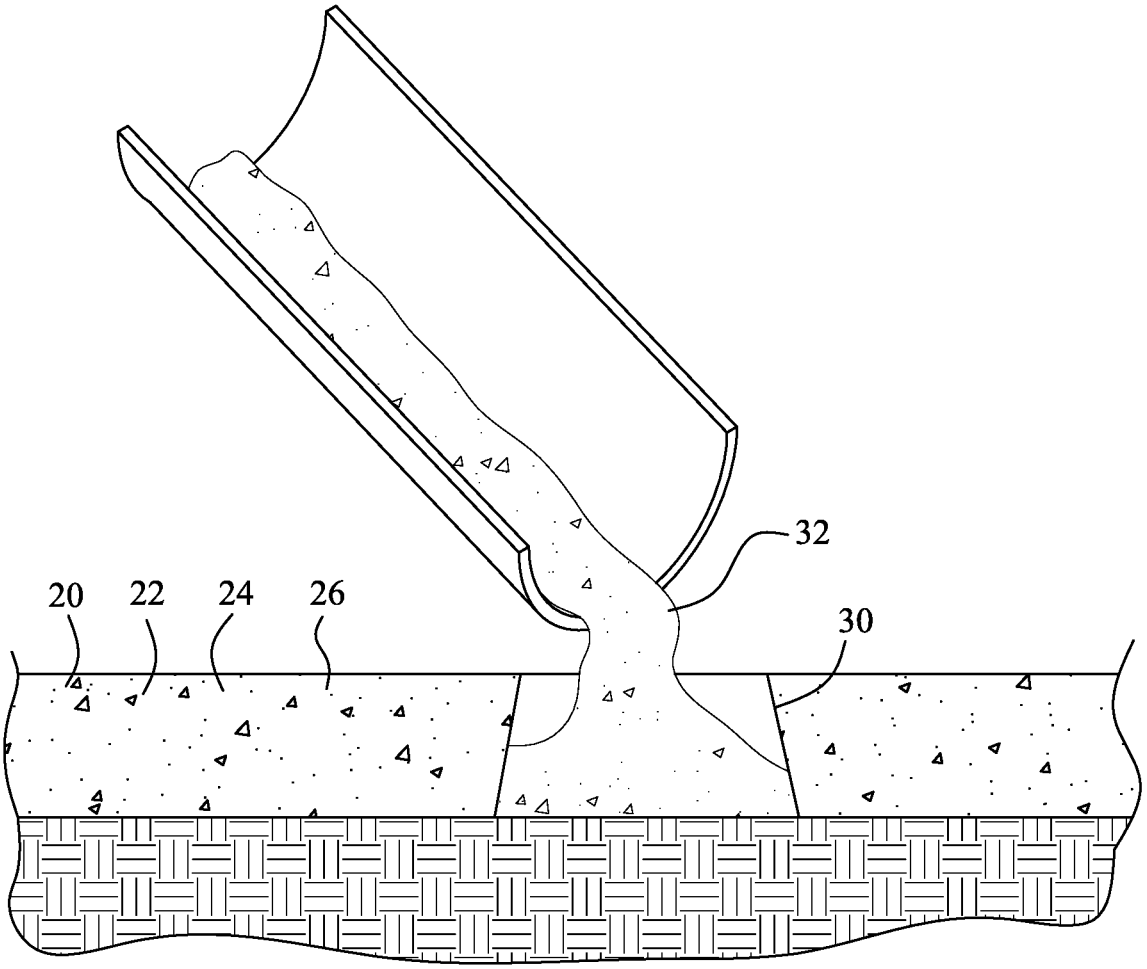
FIG. 10 is a view similar to FIG. 9 illustrating pouring a curable material into the recess.
Figure 11:
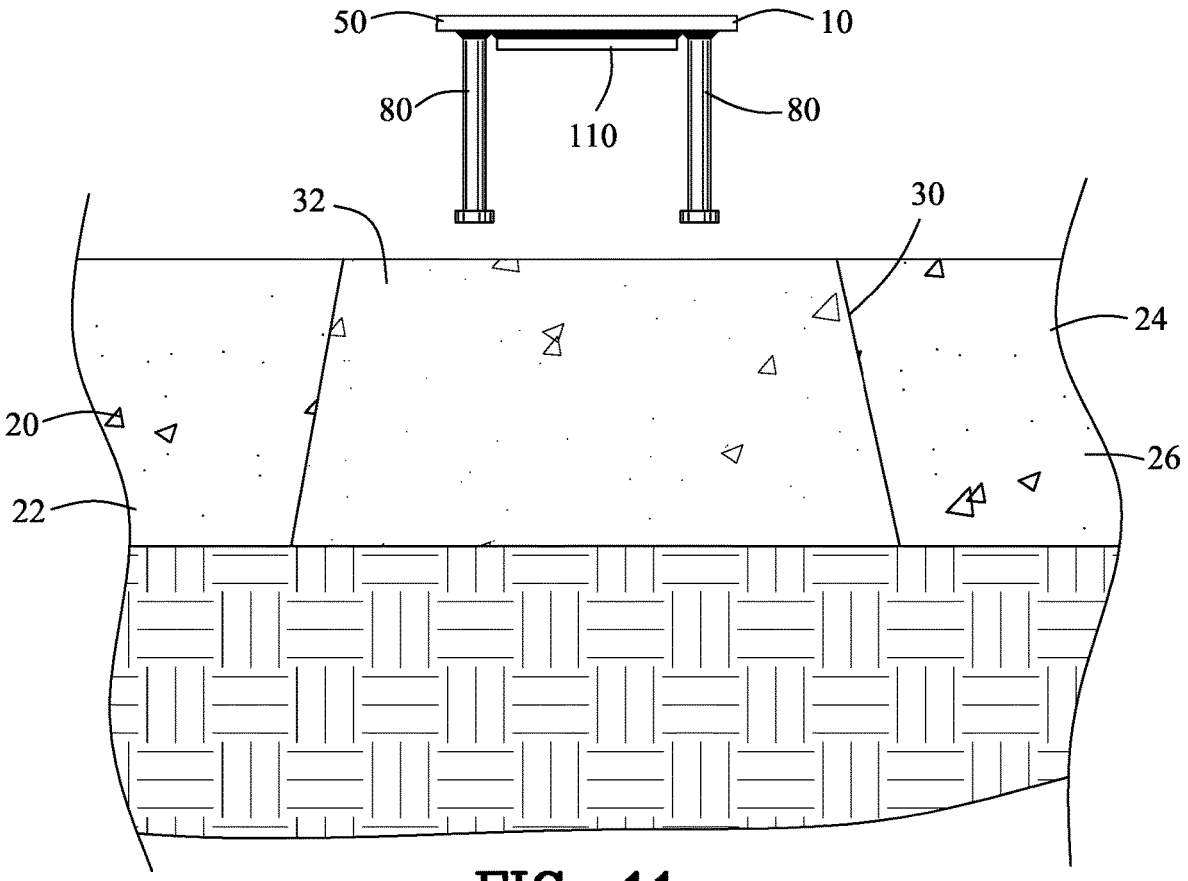
FIG. 11 is a view similar to FIG. 10 illustrating the security anchor positioned above the recess.
Figure 12:
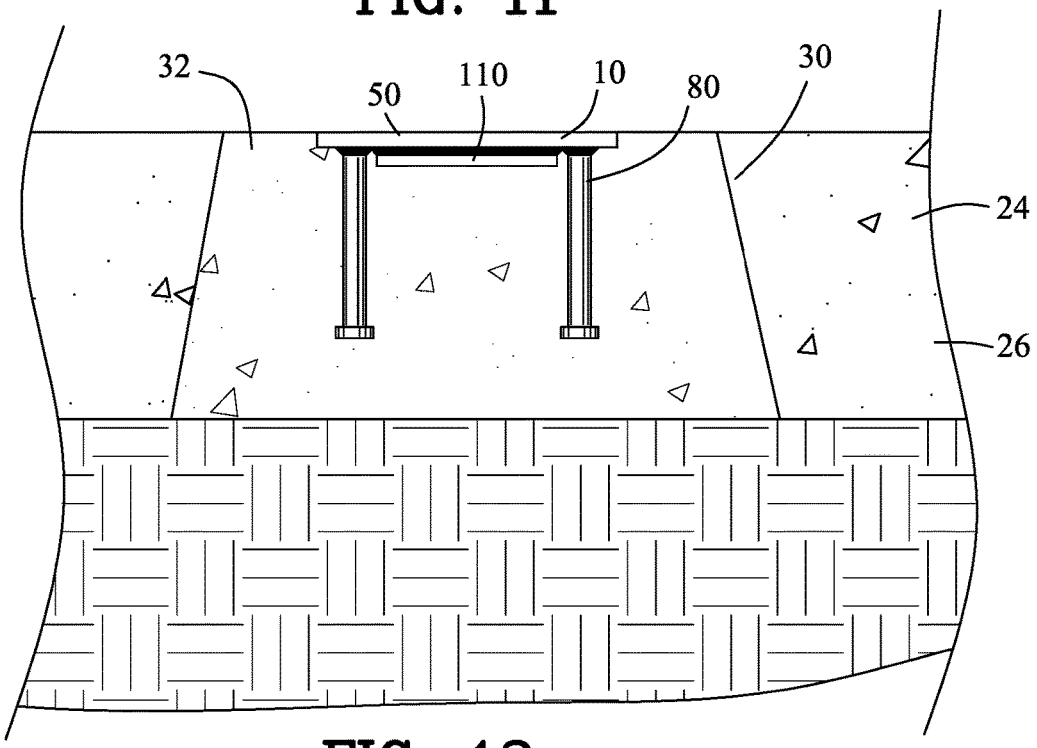
FIG. 12 is a view similar to FIG. 11 illustrating the security anchor positioned within the curable material.
Figure 14:
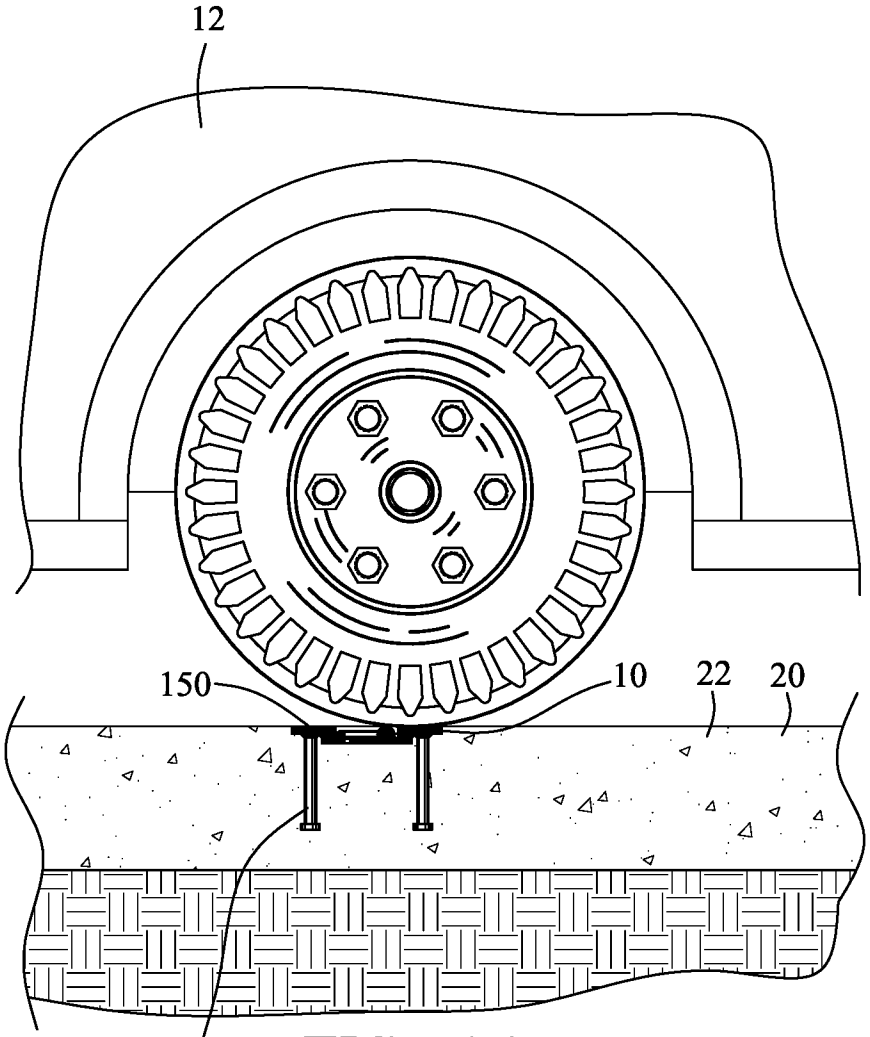
FIG. 14 is a view similar to FIGS. 8 and 12 illustrating the security anchor and the material having a flush upper surface.
Figure 13:
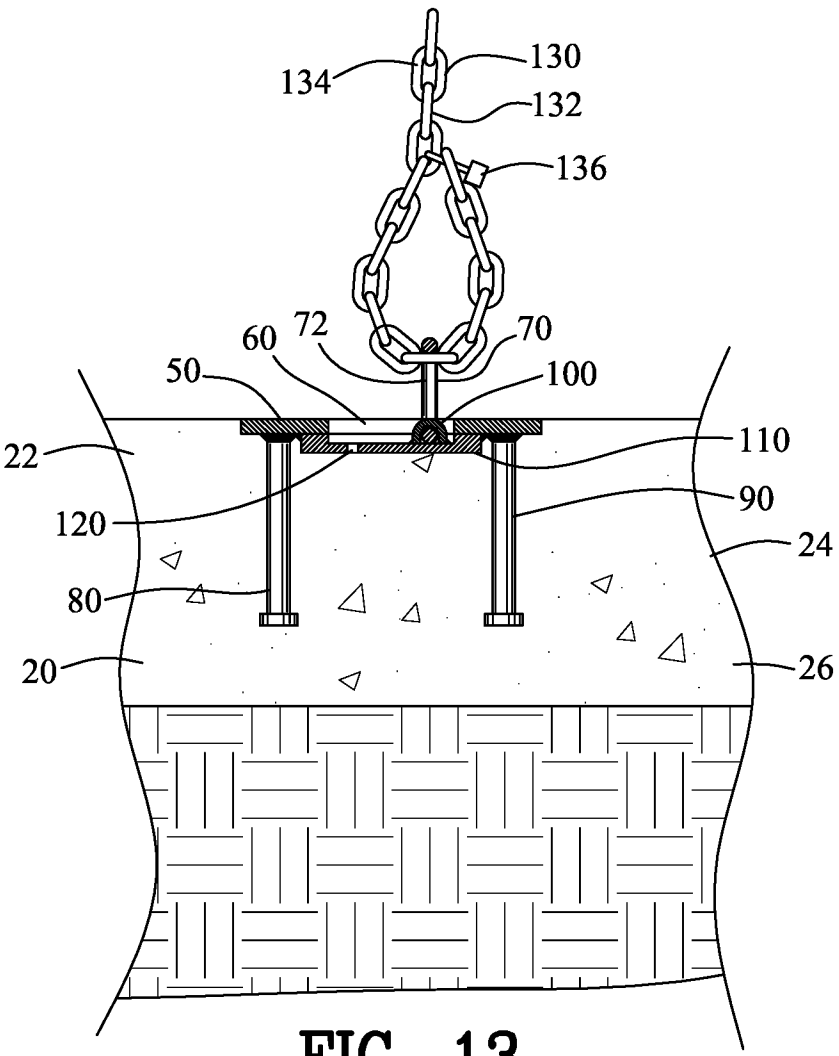
FIG. 13 is a view similar to FIGS. 8 and 12 illustrating a locking tether coupled to the security anchor.

As best shown in FIG. 13, the eyelet 70 engages with the object 12 for securing the object 12 relative to the rigid material 20. A locking tether 130 may couple the eyelet 70 with the object 12. The locking tether 130 may include but not limited to a chain 132, cable 134, rod or other elongated structures. A lock 136 may be utilized for coupling the object 12 to the security anchor 10.

The security anchor 10 may further include a sub-base 110 having a lower surface 112, an upper surface 114 and side surfaces. The upper surface 114 of the sub-base 110 is coupled to the lower surface 52 of the base 50. The sub-base 110 and base 50 may be coupled by a weld coupling 118, adhesive or other coupling means. In this configuration, the base recess 60 extends from the lower surface 52 of the base 50 to the upper surface 54 of the base 50 for defining a base aperture.

As best shown in FIGS. 1, 4, 8 and 13, the eyelet 70 may be coupled to the sub-base 110 by the pivot link 100. More specifically, the pivot link 100 may be coupled to the sub-base 110. The eyelet 70 pivotably engages with the pivot link 100 for pivoting the eyelet 70 relative to the base 50. The upper surface 54 of the base 50 and the pivot link 100 may define a flush upper surface 102 relative to the upper surface 54 of the base 50 and the pivot link 100.

The security anchor 10 may further include a drain aperture 120 in the sub-base 110 that extends between the lower surface 112 of the sub-base 110 to the upper surface 114 of the sub-base. The drain aperture 120 is positioned below the base recess 60 for draining the base recess 60 of any fluids that pool within the base recess 60.

FIG. 15 illustrates a second embodiment of the security anchor 10 wherein an anchor body 140 engages with the plurality of elongated shanks 80 for defining an independent locking anchor 142. The independent locking anchor 142 engages with the rigid material 20 for preventing the displacement of the independent locking anchor 142 relative to the rigid material 20. The anchor body 140 includes a lower surface 144, an upper surface 146 and a plurality of side surfaces 148. The upper surface 54 of the base 50, the eyelet 70 and the upper surface 146 of the anchor body 140 define a flush upper surface 150 relative to the upper surface 54 of the base 50, the eyelet 70 and the upper surface 54 of the anchor body 140. The anchor body 140 may define a trapezoid body 152 for preventing displacement of the base 50 relative to the rigid material 20.

As shown in FIGS. 5-12, the invention also incorporates a method for securing the object 12 relative to a curable material 24 on a surface. The method comprises the steps of spreading the curable material 24 on the surface. The base 50 having a plurality of anchors 80 is positioned into the curable material 24 for preventing the displacement of the base 50 relative to the curable material 24 once the curable material 24 has cured. An eyelet 70 is pivoted relative to the base 50 for coupling the object 12 to the base 50. Preferably, the upper surface 54 of the base 50 is position level with the curable material 24 for defining a linear surface or flush upper surface for avoiding impeding or obstructing an object 12 traveling over the security anchor 10.

As shown in FIGS. 9-12, the security anchor 10 and method may be utilized in a preexisting cured rigid material 20. The method comprises the steps of cutting a recess 30 into the rigid material 20. The recess 30 may include a trapezoid shaped cutout. A curable material 32 such as concrete or epoxy is then poured into the recess 30. The base 50 having a plurality of anchors 80 is positioning into the curable material 32 for preventing the displacement of the base 50 relative to the curable material 32 once the curable material 32 has cured. The eyelet 70 is pivoted relative to the base 50 for coupling the object 12 to the base 50. Preferably, the upper surface 54 of the base 50 is position level with the curable material 32 for defining a linear surface or flush upper surface for avoiding impeding or obstructing an object 12 traveling over the security anchor 10.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A security anchor engaging with a rigid material for securing an object relative to the rigid material, the security anchor comprising:

a base having a lower surface and an upper surface;

a base recess extending into said base from said upper surface of said base;

an eyelet coupled to said base and positioned within said base recess;

a plurality of elongated shanks extending between a proximal end and a distal end;

said proximal end of said plurality of elongated shanks coupled to said lower surface of said base;

said plurality of elongated shanks each having a head coupled to said distal end of said plurality of elongated shanks;

said plurality of elongated shanks and said heads engaging with the rigid material for preventing the displacement of said base relative to the rigid material;

said eyelet engaging with the object for securing the object relative to the rigid material;

a sub-base having a lower surface and an upper surface;

said upper surface of said sub-base coupled to said lower surface of said base; and said eyelet coupled to said sub-base.

2. The security anchor as set forth in claim 1, wherein said base, said plurality of elongated shanks and said heads define an integral one piece unit.

3. The security anchor as set forth in claim 1, wherein said plurality of elongated shanks and said heads define a bolt;

said bolt coupled to said lower surface of said base for defining an integral one piece unit.

4. The security anchor as set forth in claim 1, wherein said upper surface of said base and said eyelet defining a flush upper surface relative to said upper surface of said base and said eyelet.

5. The security anchor as set forth in claim 1, wherein said eyelet includes a D-ring eyelet.

6. The security anchor as set forth in claim 1, further including a pivot link coupled to said sub-base; and said eyelet pivotably engaging with said pivot link for pivoting said eyelet relative to said base.

7. The security anchor as set forth in claim 6, wherein said upper surface of said base and said pivot link defining a flush upper surface relative to said upper surface of said base and said pivot link.

8. The security anchor as set forth in claim 1, wherein said base recess extends from said lower surface of said base to said upper surface of said base;

a drain aperture in said sub-base and extending between said lower surface of said sub-base to said upper surface of said sub-base;

said drain aperture positioned below said base recess for draining said base recess.

9. The security anchor as set forth in claim 1, further including a locking tether coupling said eyelet with the object.

10. The security anchor as set forth in claim 1, further including an anchor body engaging with said plurality of elongated shanks for defining an independent locking anchor, and said independent locking anchor engaging with the rigid material for preventing the displacement of the independent locking anchor relative to the rigid material.

11. The security anchor as set forth in claim 10, wherein said anchor body includes a lower surface, an upper surface and a plurality of side surfaces; and said upper surface of said base, said eyelet and said upper surface of said anchor body defining a flush upper surface relative to said upper surface of said base, said eyelet and said upper surface of said anchor body.

12. The security anchor as set forth in claim 10, wherein said anchor body includes a lower surface, an upper surface and a plurality of side surfaces; and said plurality of side surfaces defining a trapezoid body for preventing displacement of said base relative to the rigid material.

13. A security anchor engaging with a rigid material for securing an object relative to the rigid material, the security anchor comprising:

a base having a lower surface and an upper surface;

a base recess extending into said base from said upper surface of said base;

an eyelet coupled to said base and positioned within said base recess;

a plurality of elongated shanks extending between a proximal end and a distal end;

said proximal end of said plurality of elongated shanks coupled to said lower surface of said base;

said plurality of elongated shanks each having a head coupled to said distal end of said plurality of elongated shanks;

said plurality of elongated shanks and said heads engaging with the rigid material for preventing the displacement of said base relative to the rigid material;

said eyelet engaging with the object for securing the object relative to the rigid material; and said upper surface of said base and said eyelet defining a flush upper surface relative to said upper surface of said base and said eyelet.

14. A security anchor engaging with a rigid material for securing an object relative to the rigid material, the security anchor comprising:

a base having a lower surface and an upper surface;

a base recess extending into said base from said upper surface of said base;

an eyelet coupled to said base and positioned within said base recess;

a plurality of elongated shanks extending between a proximal end and a distal end;

said proximal end of said plurality of elongated shanks coupled to said lower surface of said base;

said plurality of elongated shanks each having a head coupled to said distal end of said plurality of elongated shanks;

said plurality of elongated shanks and said heads engaging with the rigid material for preventing the displacement of said base relative to the rigid material;

said eyelet engaging with the object for securing the object relative to the rigid material; and said eyelet includes a D-ring eyelet.

15. A security anchor engaging with a rigid material for securing an object relative to the rigid material, the security anchor comprising:

a base having a lower surface and an upper surface;

a base recess extending into said base from said upper surface of said base;

an eyelet coupled to said base and positioned within said base recess;

a plurality of elongated shanks extending between a proximal end and a distal end;

said proximal end of said plurality of elongated shanks coupled to said lower surface of said base;

said plurality of elongated shanks each having a head coupled to said distal end of said plurality of elongated shanks;

said plurality of elongated shanks and said heads engaging with the rigid material for preventing the displacement of said base relative to the rigid material;

said eyelet engaging with the object for securing the object relative to the rigid material; and a locking tether coupling said eyelet with the object.

16. A security anchor engaging with a rigid material for securing an object relative to the rigid material, the security anchor comprising:

a base having a lower surface and an upper surface;

a base recess extending into said base from said upper surface of said base;

an eyelet coupled to said base and positioned within said base recess;

a plurality of elongated shanks extending between a proximal end and a distal end;

said proximal end of said plurality of elongated shanks coupled to said lower surface of said base;

said plurality of elongated shanks each having a head coupled to said distal end of said plurality of elongated shanks;

said plurality of elongated shanks and said heads engaging with the rigid material for preventing the displacement of said base relative to the rigid material;

said eyelet engaging with the object for securing the object relative to the rigid material;

an anchor body engaging with said plurality of elongated shanks for defining an independent locking anchor;

said independent locking anchor engaging with the rigid material for preventing the displacement of the independent locking anchor relative to the rigid material;

said anchor body includes a lower surface, an upper surface and a plurality of side surfaces; and said upper surface of said base, said eyelet and said upper surface of said anchor body defining a flush upper surface relative to said upper surface of said base, said eyelet and said upper surface of said anchor body.

17. A security anchor engaging with a rigid material for securing an object relative to the rigid material, the security anchor comprising:

a base having a lower surface and an upper surface;

a base recess extending into said base from said upper surface of said base;

an eyelet coupled to said base and positioned within said base recess;

a plurality of elongated shanks extending between a proximal end and a distal end;

said proximal end of said plurality of elongated shanks coupled to said lower surface of said base;

said plurality of elongated shanks each having a head coupled to said distal end of said plurality of elongated shanks;

said plurality of elongated shanks and said heads engaging with the rigid material for preventing the displacement of said base relative to the rigid material;

said eyelet engaging with the object for securing the object relative to the rigid material;

an anchor body engaging with said plurality of elongated shanks for defining an independent locking anchor;

said independent locking anchor engaging with the rigid material for preventing the displacement of the independent locking anchor relative to the rigid material;

said anchor body includes a lower surface, an upper surface and a plurality of side surfaces; and said plurality of side surfaces defining a trapezoid body for preventing displacement of said base relative to the rigid material.

* * * * *